United States Patent [19]

Fehrer

[11] 4,420,928

[45] Dec. 20, 1983

[54] APPARATUS FOR MANUFACTURING A YARN

[76] Inventor: Ernst Fehrer, Auf der Gugl 28, A-4020 Linz, Austria

[21] Appl. No.: 341,294

[22] Filed: Jan. 21, 1982

[30] Foreign Application Priority Data

Feb. 9, 1981 [AT] Austria ..... 560/81

[51] Int. Cl.[3] ..... D01H 1/12; D01H 7/882

[52] U.S. Cl. ..... 57/401; 57/334

[58] Field of Search ..... 57/5, 401, 400, 334, 57/335

[56] References Cited

U.S. PATENT DOCUMENTS

| | | | |
|---|---|---|---|
| 3,132,465 | 5/1964 | Putnam | 57/401 |
| 3,981,137 | 9/1976 | Fehrer | 57/401 |
| 4,060,966 | 12/1977 | Konig | 57/401 |
| 4,315,398 | 2/1982 | Parker et al. | 57/401 |
| 4,327,545 | 5/1982 | Fehrer | 57/401 X |
| 4,362,008 | 12/1982 | Parker et al. | 57/5 |

FOREIGN PATENT DOCUMENTS

| | | |
|---|---|---|
| 1287984 | 1/1969 | Fed. Rep. of Germany . |
| 2042387 | 4/1972 | Fed. Rep. of Germany . |

*Primary Examiner*—John Petrakes

*Attorney, Agent, or Firm*—Kurt Kelman

[57] ABSTRACT

Apparatus for manufacturing a yarn comprises two juxtaposed closely spaced apart suction drums, which rotate in the same sense and have confronting suction zones for producing a suction flow. This pulls the yarn more deeply into the triangular space between the suction drums. A drawing frame for drawing a roving that is to be pulled through the triangular space between the suction drums is disposed near one end of the suction drums. To permit the manufacture of a strong yarn without a supply of covering fibers, the two suction drums are provided with peripherally extending, confronting annular zones for roughening the roving and pulling ends fibers out of the roving. These annular zones are axially spaced from that end of the suction drums from which the yarn is withdrawn.

7 Claims, 2 Drawing Figures

APPARATUS FOR MANUFACTURING A YARN

Figure 1:
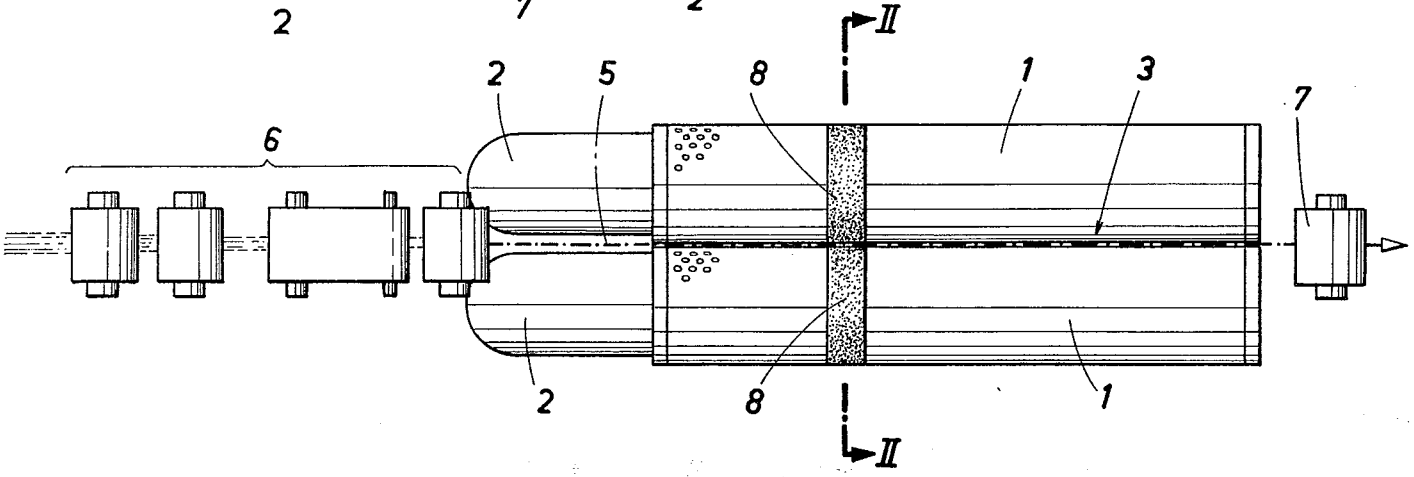

This invention relates to apparatus for manufacturing a yarn comprising two juxtaposed, closely spaced apart suction drums which define a triangular space between them, rotate in the same sense and have confronting suction zones, producing a suction flow in the triangular space, and a drawing frame which is disposed near one end of the suction drums and delivers a drawn roving into the triangular space, wherein the roving is pulled into contact with both suction drums by said suction flow.

The suction flow results in a frictional connection between the roving and the two drum surfaces which move in mutually opposite directions in the yarn-forming region. As a result of this frictional connection, the roving is twisted. But the resulting twist will be untwisted in the false-twisting sense unless the twist is fixed by covering fibers. For this purpose, my U.S. Pat. No. 4,327,545 proposes to move covering fibers transversely to the roving into the triangular space between the two suction drums and to wind covering fibers around the roving at a smaller helix angle so that the twist of the roving is fixed.

The fibers of the roving may also be held together in that, in accordance with German Patent Publication No. 1,287,984, a twist which is not uniform over the cross-section of the drawn roving is imparted to the latter, e.g., by means of a twisting nozzle so that the fibers in the core of the roving are twisted more tightly than the fibers at the surface of the roving. When the initially imparted twist is untwisted in the false-twisting sense, the less tightly twisted surface fibers will be untwisted first and will then be twisted in the opposite sense while the core is untwisted further. Owing to the twisting in different senses, the yarn contains fibers which are helically wound around the core at different helix angles so that the desired strength of the yarn is preserved.

In order to ensure a twisting of the core fibers in the manufacture of such yarns it is also known from German Opened Application No. 20 42 387 to subject the roving to a negative stretching adjacent to the false-twisting means in order to allow for the shortening of the roving resulting from the twisting of the fibers.

A main disadvantage involved in such a manufacture of a yarn resides in that the extent to which the surface fibers are twisted relative to the core fibers depends on the untwisting of the core of the roving and this untwisting depends on the non-uniform twisting of the fibers over the cross-section of the roving. For this reason it has been proposed to improve the yarn in that additional covering fibers are supplied to the roving in a direction that is transverse to the longitudinal direction of the roving before the latter is twisted. That measure permits a larger difference between the helix angles to be achieved. As it is obviously difficult to bind these additional covering fibers into the roving, the use of additional covering fibers will not result in the desired strength properties.

It is an object of the invention to avoid these disadvantages and to provide apparatus for manufacturing a strong yarn from a drawn roving without a supply of covering fibers.

In apparatus of the kind described first hereinbefore this object is accomplished in accordance with the invention in that the two suction drums are provided with two peripherally extending, confronting annular zones for roughening the roving, so that the ends of fibers of the roving are pulled out of the roving. The annular zones are axially spaced from that end of the suction drums from which the yarn is withdrawn, and the suction zones extend between the annular zones and the end of the drum from which the yarn is withdrawn.

By means of these annular zones, the roving traveling through the triangular space between the two suction drums is roughened sufficiently to pull the ends of fibers of the roving out of the body of the roving whereas the fibers engaged by the annular zones are not entirely pulled out of the roving. The fiber ends are pulled out in a substantially radial direction and immediately behind the annular zones are wound again around the roving because there is an inevitable slip between the suction drums and the roving. As a result, the fiber ends which have been virtually plucked from the roving are twisted more tightly than is usual so that the resulting yarn has the desired strength. Another advantage resides in that these more tightly twisted surface fibers are anchored in the roving because the fibers have not been pulled entirely out of the roving.

If the annular zones are axially spaced also from that end of the suction drums which is near the drawing frame, the annular zones need not contribute to the force by which the roving is twisted and these annular zones can then be designed only with a view to their intended function.

In that case the suction zones will extend between the annular zones and that end of the suction drums which is near the drawing frame.

In order to ensure that the roving will also be held in contact with the suction drums in these annular zones, the suction zones extend in or through these annular zones.

Because it is merely essential to pull fiber ends out of the body of the roving, the design of the annular zones may be freely selected. Whereas fiber ends may be pulled out of the body of the roving by electric or pneumatic forces, mechanical means may be used in very simple designs. For instance, the annular zones may be provided with protruding elevations, such as teeth, or with an air-permeable covering which is similar to a brush. The tooth or bristle must have such a shape that the tooth or bristle which has engaged a fiber will release the fiber after a rotation through a certain angle so that the fibers will not be pulled entirely out of the roving.

Figure 2:
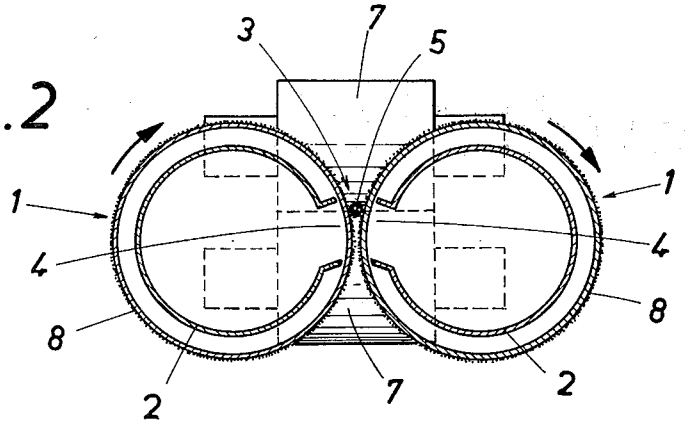

The invention is illustrated by way of example on the accompanying drawing, in which FIG. 1 is a simplified top plan view showing apparatus according to the invention for manufacturing a yarn and FIG. 2 is a transverse sectional view taken on line II—II in FIG. 1.

As is particularly apparent from FIG. 1, the apparatus shown comprises two juxtaposed, closely spaced apart suction drums 1, which rotate in the same sense and each of which comprises a suction insert 2. In the generally triangular space 3 between the suction drums 1, the two suction inserts 2 form confronting suction zones 4. By means of these suction zones 4, a roving 5 which travels through the triangular space 3 is pulled more deeply into the triangular space 3 so that both suction drums 1 are contacted by the roving at the same time, regardless of the diameter of the roving, and the latter is twisted by said suction drums. The roving 5 is withdrawn from rollers of a drawing frame 6, which is provided near one end of the suction drums, and is moved to a pair of withdrawing rollers 7 near the other end of the suction drums.

The roving 5 which has been twisted by the suction drums 1 is held against rotation by the rollers of the drawing frame 6 and by the withdrawing rollers 7. To prevent an untwisting of the roving 5 in a false-twisting sense adjacent to the two suction drums 1, the latter are provided with two peripherally extending, confronting air-permeable annular zones 8, which are axially spaced from that end of the suction drums from which the yarn is withdrawn and which have teeth or bristles for roughening the roving. The teeth or bristles pull individual fibers at one end from the body of the roving. Immediately after the annular zones 8, said fiber ends which have been pulled out are wound around the roving because, owing to the inevitable slip, the surfaces of the suction drums must be moved at a higher peripheral velocity than the roving and the roving is additionally snubbed by the untwisting force. As a result, the pulled out ends of the fibers which were engaged by the annular zones 8 and at one end are still anchored in the body of the roving are tightly wound around the roving so that the desired coherence of the roving and the desired strength of the yarn are reliably achieved.

What is claimed is:

1. In apparatus for manufacturing a yarn, comprising two juxtaposed, closely spaced apart suction drums defining a generally triangular space therebetween and adapted to be rotated in the same sense, the drums having confronting suction zones, a drawing frame disposed near one end of said suction drums and operable to deliver a roving into said triangular space, said suction zones being operable to produce in said triangular space a suction flow tending to pull said roving in said triangular space into contact with said suction drums so that said suction drums, when rotated in the same sense, will twist said roving to form a yarn, and withdrawing means disposed near the other end of said suction drums and operable to withdraw said yarn from said triangular space, the improvement of peripherally extending, confronting annular roughening zones on said suction drums, said roughening zones being axially spaced from said other end of said suction drums and being adapted to pull the ends of fibers of said roving out of said roving and to wind the fibers around said roving in said triangular space, and said suction zones extending between said annular roughening zones and said other end of said suction drums.

2. The improvement set forth in claim 1, wherein said annular roughening zones are axially spaced from said one end of said suction drums and said suction zones extend between said annular zones and said one end of said suction drums.

3. The improvement set forth in claim 1, wherein said suction roughening zones extend in said annular zones.

4. The improvement set forth in claim 1, wherein said annular roughening zones are provided with protruding elevations.

5. The improvement set forth in claim 1, wherein said annular roughening zones are set with teeth.

6. The improvement set forth in claim 1, wherein each of said annular roughening zones is provided with a brushlike covering.

7. The improvement set forth in claim 6, wherein said coverings are air-permeable and said suction zones extend under said coverings.

* * * * *